US009925449B2

(12) United States Patent
Salmon

(10) Patent No.: US 9,925,449 B2
(45) Date of Patent: Mar. 27, 2018

(54) HEAD MOUNTED TRAINING AID

(71) Applicant: Barbara Anne Salmon, Palm Desert, CA (US)

(72) Inventor: Barbara Anne Salmon, Palm Desert, CA (US)

(73) Assignee: PROGRESSIVE INNOVATIONS, LLC, Holland, OH (US)

( * ) Notice: Subject to any disclaimer, the term of this patent is extended or adjusted under 35 U.S.C. 154(b) by 16 days.

(21) Appl. No.: 15/201,807

(22) Filed: Jul. 5, 2016

(65) Prior Publication Data

US 2017/0001092 A1 Jan. 5, 2017

Related U.S. Application Data

(60) Provisional application No. 62/188,179, filed on Jul. 2, 2015.

(51) Int. Cl.
*A63B 69/36* (2006.01)
*A63B 23/025* (2006.01)

(52) U.S. Cl.
CPC ..... *A63B 69/3608* (2013.01); *A63B 69/3614* (2013.01); *A63B 23/025* (2013.01); *A63B 69/3676* (2013.01); *A63B 2207/02* (2013.01); *A63B 2208/0204* (2013.01); *A63B 2220/18* (2013.01)

(58) Field of Classification Search
USPC ..... 473/207–211, 266–268, 409
See application file for complete search history.

(56) References Cited

U.S. PATENT DOCUMENTS

| | | | | |
|---|---|---|---|---|
| 4,303,244 | A | 12/1981 | Uppvall | |
| 5,467,992 | A | 11/1995 | Harkness | |
| 5,879,239 | A | 3/1999 | Macroglou | |
| 6,467,929 | B2 * | 10/2002 | Lee | A42B 1/242 362/190 |
| 6,902,493 | B1 | 6/2005 | Rhodes et al. | |
| 6,939,245 | B1 * | 9/2005 | Mullarkey | A42B 1/24 362/191 |
| 7,207,896 | B1 | 4/2007 | Sudol | |
| 7,229,361 | B1 | 6/2007 | Park et al. | |
| 2003/0045368 | A1 * | 3/2003 | Farmer | A63B 69/3608 473/268 |

(Continued)

FOREIGN PATENT DOCUMENTS

| | | | |
|---|---|---|---|
| JP | 0102267 | A | 1/1989 |
| JP | 08215365 | A | 8/1996 |

(Continued)

*Primary Examiner* — Nini Legesse
(74) *Attorney, Agent, or Firm* — Shumaker, Loop & Kendrick, LLP; James D. Miller

(57) ABSTRACT

A training aid includes a frame configured for mounting on a head of a user and a light indicator coupled to the frame. The light indicator includes a light source configured to generate a beam of visible light extending away from the light source. The light indicator includes a first casing segment pivotally coupled to the frame and a second casing segment pivotally coupled to the first casing segment, wherein the light source is disposed in the second casing segment. The light indicator further includes an inclinometer configured to control operation of the light source depending on a tilt angle of the light indicator.

14 Claims, 4 Drawing Sheets

(56) References Cited

U.S. PATENT DOCUMENTS

| | | | | |
|---|---|---|---|---|
| 2008/0268975 | A1* | 10/2008 | Levis | A63B 69/3667 473/218 |
| 2010/0076528 | A1* | 3/2010 | Zeller | A61H 5/00 607/89 |
| 2012/0242697 | A1* | 9/2012 | Border | G02B 27/0093 345/633 |
| 2014/0309050 | A1* | 10/2014 | Nell | A63B 69/3608 473/209 |

FOREIGN PATENT DOCUMENTS

| | | | |
|---|---|---|---|
| JP | 2006223443 | A | 8/2006 |
| KR | 2020090000779 | U | 1/2009 |
| WO | 2005094952 | A1 | 10/2005 |

* cited by examiner

HEAD MOUNTED TRAINING AID

CROSS-REFERENCE TO RELATED APPLICATION

This application claims priority to U.S. Provisional Patent Application Ser. No. 62/188,179, filed Jul. 2, 2015, the entire disclosure of which is hereby incorporated herein by reference.

FIELD OF THE INVENTION

The invention relates to a light sight, and more specifically to a light sight coupled to a frame configured for mounting on a user.

BACKGROUND OF THE INVENTION

Various recreational activities, such as athletic activities or competition based activities, often require precise and repeatable motions to consistently achieve success. Such motions typically require extensive and repeatable training to achieve the desired degree of improvement. One difficulty commonly faced relating to such activities involves an inability to diagnose why certain movements are not resulting in the desired outcome. To address this issue, it is not uncommon for a trainer or coach to be utilized to provide instruction while observing the associated movement that may be frustrating success, thereby providing context on how to improve the associated movement. However, the use of a second party such as a coach or trainer can be time consuming, expensive, and in many cases, impractical when attempting to improve at an activity that requires multiple practice sessions to see substantial and consistent improvement.

One such activity includes golfing. Many golfers struggle to consistently make desirable contact with a golf ball while performing a variety of different strokes and shots. The lack of consistency is often a result of the golfer unknowingly introducing slight variations in movement to the golfer's swing with each repeated attempt. The lack of precisely controlled and repeatable movements accordingly leads to the club face striking the ball at various different angular positions which result in inconsistent contact, and hence inconsistent shot placement.

For example, many golfers struggle heavily with the issue of unnecessary motion of the head during the act of completing a golf stroke. This problem may be particularly problematic when performing the act of putting. Many golfers tend to raise or lower the head during the process of putting, resulting in a putt where the putter face makes less than desirable contact with the ball such as striking an upper portion or a lower portion of the ball. Other golfers have great difficult remaining still in the moments leading up to the putt, causing unnecessary movement and misalignment immediately prior to the beginning of the putting stroke. Still, other golfers tend to sway, rock, or otherwise improperly transfer weight during the act of putting, causing additional misalignment of the putting path. In all cases, the issues encountered are the result of the golfer having a lack of control of his or her body immediately prior to and during the putting stroke.

It is often increasingly difficult for many golfers to correct such problems as the extremely minor variations from one putt to the next are often difficult to sense or quantify when attempting to diagnose potential issues. Accordingly, many golfers struggle to correct potential issues with their swing or putting stroke as there is no effective way for such golfers to monitor the movements of their bodies that may be resulting in less than desirable golf shots.

In addition to athletic pursuits, it is often desirable to track the precise movements of a person while in the act of exercising, training, or rehabilitating injuries. For example, it may be beneficial to track the movement of a person when performing physical therapy exercises requiring relatively little motion of the corresponding portions of the body. Many individuals suffering from neck or spinal injuries may be limited in or incapable of rotating or tilting his or her head through a desired range of motion. The relative stiffness of such muscles and joints may make it difficult for such an individual undergoing the physical therapy to monitor his or her progress due to the perceived lack of motion occurring during the prescribed exercises. Similarly, it may be difficult for such an individual to monitor his or her form in performing the prescribed exercises, causing the therapy to be ineffective.

It would therefore be desirable to produce a device configured to accurately monitor a position or a relative movement of a portion of a body of a user when carrying out a prescribed motion.

SUMMARY OF THE INVENTION

Compatible and attuned with the present invention, a device configured to monitor an angular position and/or orientation of a portion of a body of a user has surprisingly been discovered.

In an embodiment of the invention, a training aid comprises a frame and a light indicator coupled to the frame. The light indicator includes a light source configured to generate a beam of visible light.

A method of using a training aid is also disclosed. The method includes the steps of mounting the training aid to a user, wherein the training aid includes a light source for generating a beam of visible light and a distal end of the beam of visible light forms a pointer; directing the pointer of the beam of visible light on a target; and monitoring a position of the pointer of the beam of visible light relative to the target.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
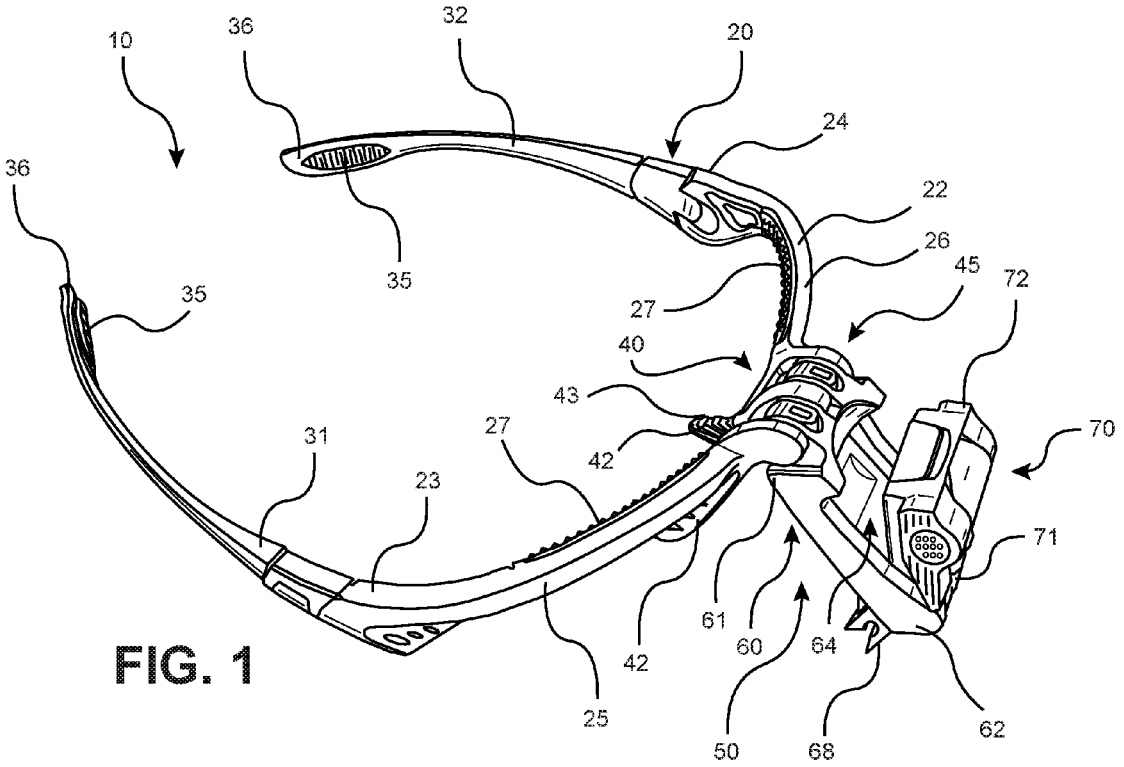
FIG. 1 is a perspective view of a training aid according to one embodiment of the invention.
Figure 2:
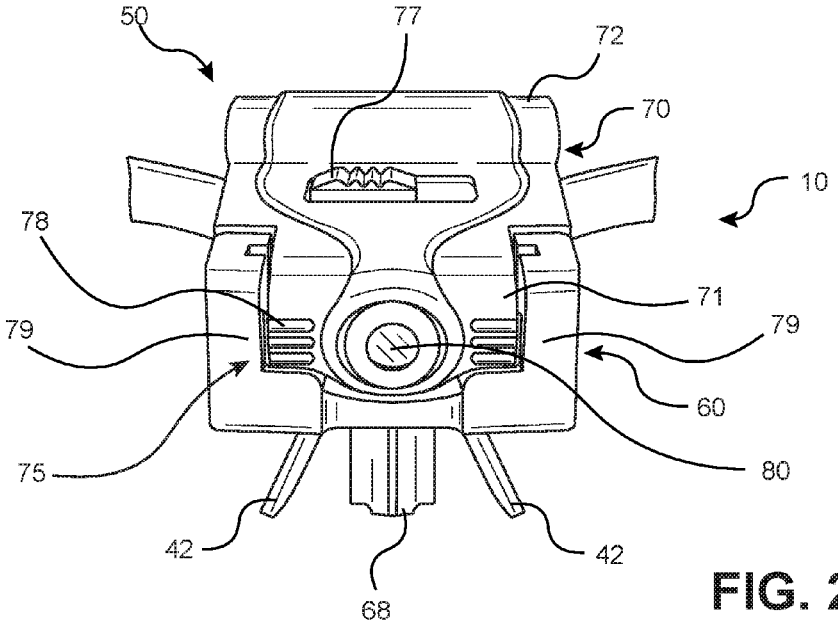
FIG. 2 is an enlarged fragmentary front perspective view of a portion of the training aid illustrated in FIG. 1.
Figure 3:
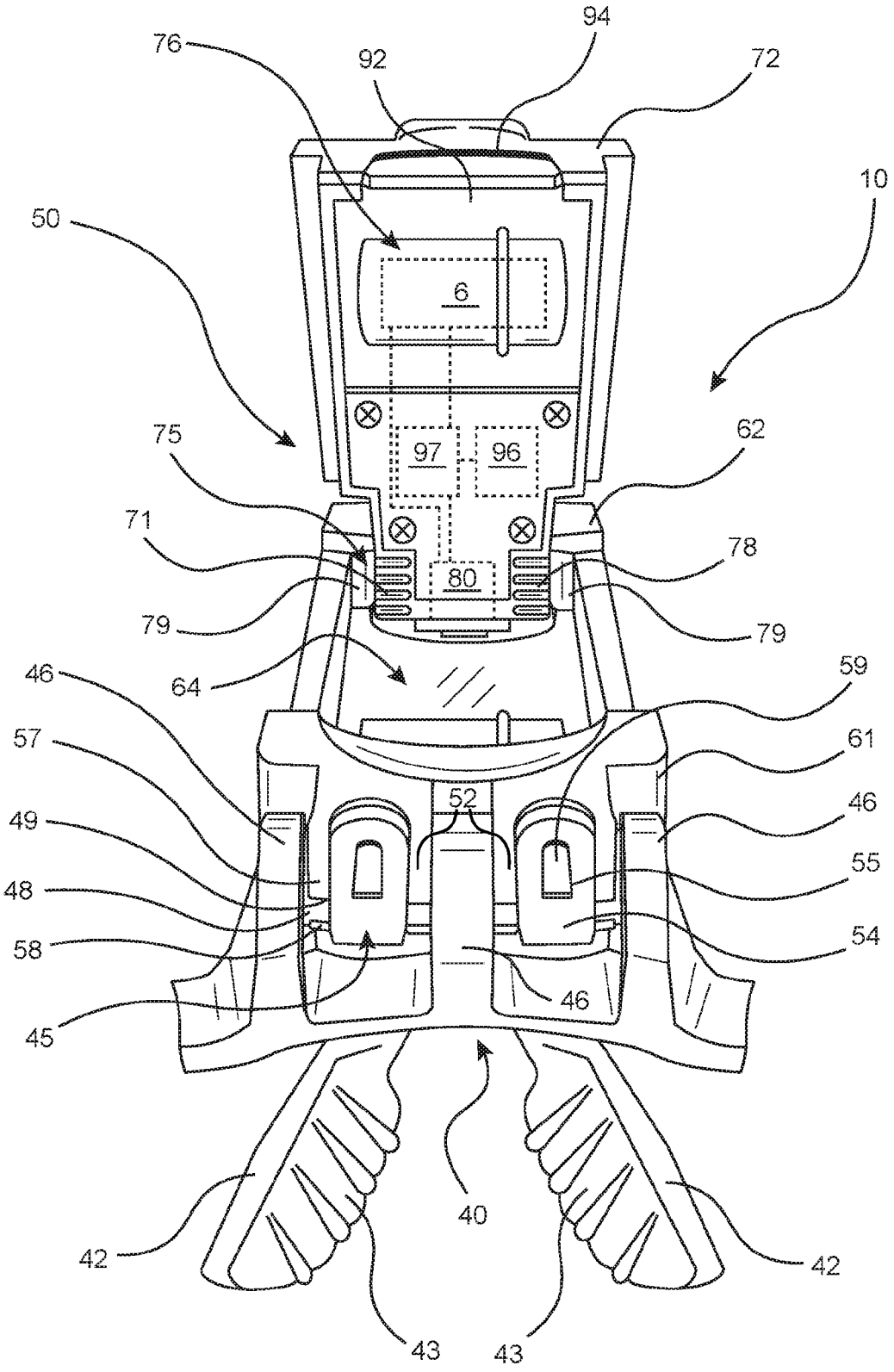
FIG. 3 is an enlarged fragmentary rear perspective view of a portion of the training aid illustrated in FIG. 1.

FIGS. 1-3 illustrate a training aid 10 according to an embodiment of the invention. The training aid 10 may be used for a variety of training applications including golf training and physical therapy training, as non-limiting examples. The training aid 10 includes a frame 20 and a light indicator 50 pivotally coupled to the frame 20.

The frame 20 of the training aid 10 is configured to be positioned on a face of a user. Thus, the frame 20 may substantially resemble a frame of a traditional pair of eyeglasses. The frame 20 includes a front bar 22 having a first end 23 and a second end 24. The first end 23 of the front bar 22 is hingedly coupled to a first temple bar 31 and the second end 24 of the front bar 22 is hingedly coupled to a second temple bar 32. The first temple bar 31 and the second temple bar 32 may each have a slight curvature to cause the first temple bar 31 and the second temple bar 32 to extend at least partially around the head of the user. The first temple bar 31 and the second temple bar 32 may each include a temple comfort pad 35 disposed on a temple tip 36 formed at a distal end of each of the respective temp bars 31, 32. The temple comfort pad 35 may be disposed on an inner surface of each of the temple tips 36 to allow for the training aid 10 to be comfortably placed over the ears of the user. The temple comfort pad 35 may be formed from a relatively soft and resilient material such as rubber, as a non-limiting example. The temple comfort pad 35 may include a plurality of spaced apart raised portions formed of the soft and resilient material, for example.

The front bar 22 of the frame 20 may be curved in a manner substantially corresponding to a shape of the forehead of the user to allow for a proper placement of the training aid 10. The front bar 22 includes a first bar portion 25 formed adjacent the first end 23 of the front bar 22 and a second bar portion 26 formed adjacent the second end 24 of the front bar 22. The first bar portion 25 may be configured to rest on the forehead of the user adjacent the right eye socket of the user whereas the second bar portion 26 may be configured to rest on the forehead of the user adjacent the left eye socket of the user. The first bar portion 25 and the second bar portion 26 may each include a bar comfort pad 27 disposed on an inner surface thereof. The bar comfort pad 27 may be formed from a relatively soft and resilient material such as rubber, as a non-limiting example. The bar comfort pad 27 may include a plurality of spaced apart raised portions formed of the soft and resilient material, for example.

The front bar 22 of the frame 20 is formed in the absence of any structure extending therefrom for surrounding an eye of the user. As opposed to a pair of traditional eye glasses which include additional structure for maintaining a lens of the eye glasses, the frame 20 is devoid of the additional structure to allow the training aid 10 to be worn concurrently with a pair of eye glasses, as needed. The lack of a lens and the associated framing structure further beneficially allows for a sight line of the user to be unobstructed when the training aid 10 is disposed on the head of the user.

A bridge 40 of the frame 20 extends between the first bar portion 25 and the second bar portion 26 at a central region of the frame 20. The bridge 40 includes a pair of downwardly extending nose pads 42, wherein each of the nose pads 42 may include a nose comfort pad 43 formed on an inner surface thereof for providing comfort to the user when the frame 20 is disposed over the nose of the user. Each of the nose comfort pads 43 may be formed from a relatively soft and resilient material such as rubber, as a non-limiting example. The nose comfort pad 43 may include a plurality of spaced apart raised portions formed from the soft and resilient material.

A first hinge assembly 45 hingedly and rotatably couples the light indicator 50 to the bridge 40 of the frame 20. The first hinge assembly 45 is illustrated in FIGS. 1 and 3 as including three knuckles 46 having a pin 48 connecting the knuckles 46 together. It should be understood that the first hinge assembly 45 may include fewer or more of the knuckles 46 or have other configurations suitable for forming a pivoting connection, as desired. The pin 48 may be formed integrally with the knuckles 46 or the pin 48 may be fed through apertures formed in the knuckles 46, as desired.

The light indicator 50 includes a first casing segment 60 and a second casing segment 70. The first casing segment 60 extends from a first end 61 to a second end 62. The first end 61 of the first casing segment 60 is pivotally coupled to the frame 20 via the first hinge assembly 45 and the second end 62 of the first casing segment 60 is pivotally coupled to the second casing segment 70 via a second hinge assembly 75.

The first casing segment 60 includes a pair of knuckles 52 extending from the first end 61 thereof forming a portion of the first hinge assembly 45. Each of the knuckles 52 is configured to receive the pin 48 extending between the knuckles 46 therein. The knuckles 52 may include an opening 49 formed therein for receiving the pin 48 therein. The opening 49 divides each of the knuckles 52 into a first portion 57 and a second portion 58. The first portion 57 includes a projection 59 extending therefrom and the second portion 58 similarly includes a projection (not shown) extending therefrom.

A snap-fit fastener 54 may be used to secure each of the knuckles 52 to the pin 48 extending between the knuckles 46 and facilitate a rotational movement of the pin 48 within the knuckles 52. The snap-fit fastener 54 may for example be formed from a bent strip of material having two legs thereof formed into a V-shape. An opening 55 may be formed adjacent a distal end of each of the legs of the snap-fit fastener 54. The snap-fit fastener 54 engages each of the knuckles 52 once the pin 48 of the first hinge assembly 45 is received in the opening 49 formed between the first portion 57 and the second portion 58 of each of the knuckles 52. The distal end of each of the legs of the V-shaped snap-fit fastener 54 extends over one of the first portion 57 and the second portion 58 to cause the snap-fit fastener 54 to resiliently extend over each of the knuckles 52 until the openings 55 of the snap-fit fastener 54 receive the projections 59 extending from each of the knuckles 52. The snap-fit fastener 54 then resiliently returns to a retracted position wherein the projections 59 are maintained within the openings 55, thereby pivotally coupling the first casing segment 60 to the bridge 40 of the frame 20.

The pivotal connection formed by the first hinge assembly 45 may be configured to have a preselected degree of friction or interference fit formed between the knuckles 46 of the frame 20 and the knuckles 52 of the light indicator 50 or between the knuckles 52 and the pin 48 to allow for the light indicator 50 to be pivoted to and maintained at a desired rotational position relative to the frame 20. The knuckles 46, the knuckles 52, and the pin 48 may each be formed to include stepped, knurled, or irregular surfaces that interact with or engage each other to create the desired degree of friction or interference fit to cause the light indicator 50 to be maintained at the desired position.

The first casing segment 60 may further include a snap-fit connector 68 depending from an underside thereof. The snap-fit connector 68 is formed adjacent the second end 62 of the first casing segment 60. The snap-fit connector 68 includes a pair of outwardly extending projections having angled surfaces suitable for resiliently receiving an accessory (not shown) between the angled surfaces. The projections are configured to resiliently return to an original position following entry of the accessory between and through each of the angled surfaces, thereby retaining the accessory within the snap-fit connector 68. The accessory may for example be configured for use with a specific training application using the training aid 10. Alternatively, the snap-fit connector 68 may be suitable for retaining the training aid 10 on a feature such as a cable or cord. The cable or cord may extend from a storage device such as a golf bag, thereby allowing the training aid 10 to be easily stowed between training sessions.

The second casing segment 70 extends from a first end 71 to a second end 72. The first end 71 of the second casing segment 70 is pivotally coupled to the second end 62 of the first casing segment 60 by the second hinge assembly 75. The second hinge assembly 75 may include a knuckle 78 disposed between a pair of knuckles 79. The knuckle 78 may be a portion of the second casing segment 70 adjacent the first end 71 thereof and the knuckles 79 may each be formed by spaced apart lateral portions of the first casing segment 60 adjacent the second end 62 thereof. The knuckles 79 may include openings (not shown) formed therein for receiving the ends of a pin (not shown) extending from each side of the knuckle 78. The pin may be formed integrally with the knuckle 78 or the pin may be fed through an aperture extending through the knuckle 78, as desired.

The pivotable connection formed by the second hinge assembly 75 may be configured to have a preselected degree of friction or interference fit formed between the knuckle 78 and the pin or between the knuckles 79 and the pin to allow for the second casing segment 70 to be pivoted to and maintained at a desired pivotal position relative to the first casing segment 60. The knuckle 78, the knuckles 79, and the pin may each be formed to include stepped, knurled, or irregular surfaces that interact with or engage each other to create the desired degree of friction or interference to cause the second casing segment 70 to be maintained at the desired pivotal position, as desired.

An axis of rotation of the first hinge assembly 45 may be formed to be substantially parallel to an axis of rotation of the second hinge assembly 75. The first hinge assembly 45 and the second hinge assembly 75 cooperate to allow for a light source 80 to be adjustable to a variety of different angular positions. Pivoting of the light indicator 50 about the first hinge assembly 45 causes the axis of rotation of the second hinge assembly 75 to orbit relative to the axis of rotation of the first hinge assembly 45. The orbiting results in a repositioning of the axis of rotation of the second hinge assembly 75 to allow for adjustment of the light source 80 to various different orientations and positions that may be required to adapt the training aid 10 for use with different users who may have alternative facial structures or the like requiring adjustment of the training aid 10 to ensure the optimal angle for the light source 80 is attainable during use of the training aid 10.

The first casing segment 60 further includes an opening 64 formed in an upper surface thereof for receiving the second casing segment 70 therein when the second casing segment 70 is fully rotated in a direction toward an upper surface of the first casing segment 60. The opening 64 may have a size and shape substantially corresponding to a size and a shape of the second casing segment 70, as desired.

A portion of the second casing segment 70 formed adjacent the second hinge assembly 75 includes the light source 80 extending therefrom. The light source 80 may be any light source suitable for generating a beam of visible light linearly projecting from the light source 80. The light source 80 may accordingly include a laser and a substantially cylindrical lens positioned perpendicularly to the beam of visible light projecting from the laser, as a non-limiting example. It should be appreciated, however, that any form of light source suitable for forming a linearly extending beam of visible light may be used without departing from the scope of the present invention. The light source 80 is configured to pivot in unison with a remainder of the second casing segment 70 when the second casing segment 70 is caused to pivot relative to the first casing segment 60 about the second hinge assembly 75.

The second casing segment 70 further includes a battery compartment 76 and a power switch 77. The battery compartment 76 may be an opening formed adjacent the second end 72 of the second casing segment 70. The battery compartment 76 may receive any suitable type of battery (not shown) for powering the training aid 10, as desired. The battery compartment 76 may be accessed by removing an access panel 92 used to close off the battery compartment 76. The access panel 92 is shown in FIG. 3 as being in facing relationship with the opening 64 of the first casing segment 60 when the first casing segment 60 and the second casing segment 70 are rotated toward each other to a closed position. The access panel 92 may include an access feature 94 for removing the access panel 92 from the second casing segment 70. The access feature 94 may for example be a gap formed between the second casing segment 70 and the access panel 92 to allow for a prying device of the user to enter the access feature 94 to separate the access panel 92 away from the second casing segment 70 to gain access to the battery compartment 76.

The power switch 77 is formed on a surface of the second casing segment 70 opposite the battery compartment 76. The power switch 77 may be any form of suitable switch or actuating device configured to be adjusted from an "off" position to an "on" position, as desired. The power switch 77 is illustrated in FIG. 2 as being linearly slidable between two positions, but it should be understood that the power switch 77 may be rotatable switch, a push button switch, or other type of switch, as non-limiting examples. The power switch 77 may be located elsewhere on the training aid 10, as desired.

The second casing segment 70 may further include an inclinometer 96 and a controller 97 disposed therein. The inclinometer 96 may be any form of tilt detecting device. The inclinometer 96 may be an accelerometer, a liquid capacitive inclinometer, an electrolytic inclinometer, a gas bubble in liquid type inclinometer, or a pendulum type inclinometer, as non-limiting examples. The inclinometer 96 is configured to continuously monitor an angle (tilt) of the light source 80 (and hence the beam of visible light) relative to vertical. However, the inclinometer 96 may be adapted to monitor the tilt angle of the light source 80 with respect to any frame of reference, as desired.

The controller 97 may include a non-transitory storage medium, an instruction set stored to the storage medium, and a processor for computing the instruction set. The controller 97 is configured to receive control signals generated by the inclinometer 96 indicating the tilt angle of the light source 80. The controller 97 is further configured to make a determination when the electrical energy stored in the battery 6 is to be transferred to the light source 80 based on the reception of the control signal from the inclinometer 96 and other functions as desired.

The training aid 10 may be suitable for a variety of applications and methods. One representative application involves the training of a user to perform a putting stroke. First, the user places the training aid 10 on the head in a manner wherein the frame 20 is disposed on the head of the user in similar fashion to a traditional pair of eyeglasses, wherein the temple tips 36 extend around each of the ears of the user, the front bar 22 is contacting or resting adjacent the forehead of the user, and the nose pads 42 are resting on a bridge of the nose of the user. The user may then switch the power switch 77 from the "off" position to the "on" position.

When the power switch 77 is actuated to the "on" position, the inclinometer 96 monitors a tilt angle of the light source 80. The inclinometer 96 sends data to the controller 97 indicating the tilt angle of the light source 80. The controller 97 then analyzes the data sent from the inclinometer 96 to determine if the light source 80 is directed at an angle that is deemed to be out of the range of acceptable angles for safe or desired use of the training aid 10. If the controller 97 determines that the light source 80 is directed at a suitable angle for use, the controller 97 generates a control signal indicating that the electrical energy of the battery 6 is to be delivered to the light source 80 to cause the beam of visible light to be generated. If the controller 97 determines that the light source 80 is directed at an unacceptable angle, the controller 97 ceases the transfer of the electrical energy from the battery 6 to the light source 80, resulting in the beam of visible light not being generated by the light source 80 despite the positioning of the power switch 77 in the "on" position.

The inclinometer 96 and the controller 97 accordingly form a safety feature of the training aid 10. The ability of the light source 80 to be deactivated when the light source 80 is directed at certain preselected angles allows for the training aid 10 to be used without potentially directing the light beam directly at the eyes of a third party present during the use of the training aid 10, which could cause damage to the retina of the eye of the third party.

Figure 4:
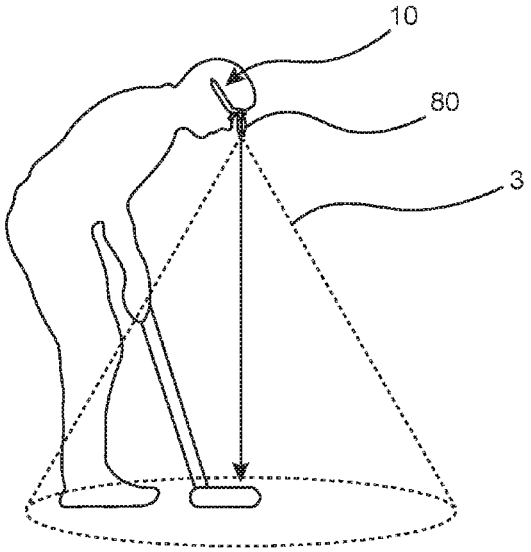
FIG. 4 is a perspective view illustrating an example of a permissible range of tilt angles for the training aid illustrated in FIGS. 1-3.

For example, use of the training aid 10 in a golf training exercise may result in the light source 80 typically being directed in a downward direction while in use. The inclinometer 96 and the controller 97 may accordingly be configured to cease generation of the light beam when the inclinometer 96 and the controller 97 determine that the light source 80 has angularly deviated from the downward or vertical direction by a predetermined angle. For example, the inclinometer 96 and the controller 97 may cease generation of the light beam when the user of the training aid 10 has tilted the light source 80 more than 30° away from the downward or vertical direction, as shown in FIG. 4. When the light source 80 is directed between the vertical downward direction and a direction deviated therefrom by 30° or less, the light source 80 remains on and the beam of visible light is generated. When the light source 80 is deviated from the vertical downward direction by more than 30°, the light source 80 is caused to cease operation by the controller 97 upon receiving the control signal from the inclinometer 96 and the beam of visible light is no longer generated. For the example provided, the range of angles through which the light source 80 is activated to create the beam of light is shown in FIG. 4 by a bound cone shape indicated by numeral 3. As illustrated in FIG. 4, the preselected angle of 30° results in a situation wherein it is unlikely that a third party could be negatively affected by the light beam emanating from the light source 80 due to the limited range of positions that could potentially be encountered by the beam of visible light.

It should be understood, however, that the inclinometer 96 may be used for other applications and for other ranges of tilt of the light source 80. Additionally, it should further be understood that some applications of the training aid 10 may not require use of the inclinometer 96 when a full range of motion of the light beam is desired. For example, the inclinometer 96 may not be utilized in the training aid 10 for applications of the training aid 10 requiring the user of the training aid 10 to direct the beam of visible light in a substantially horizontal direction, as described in greater detail hereafter.

Figure 5:
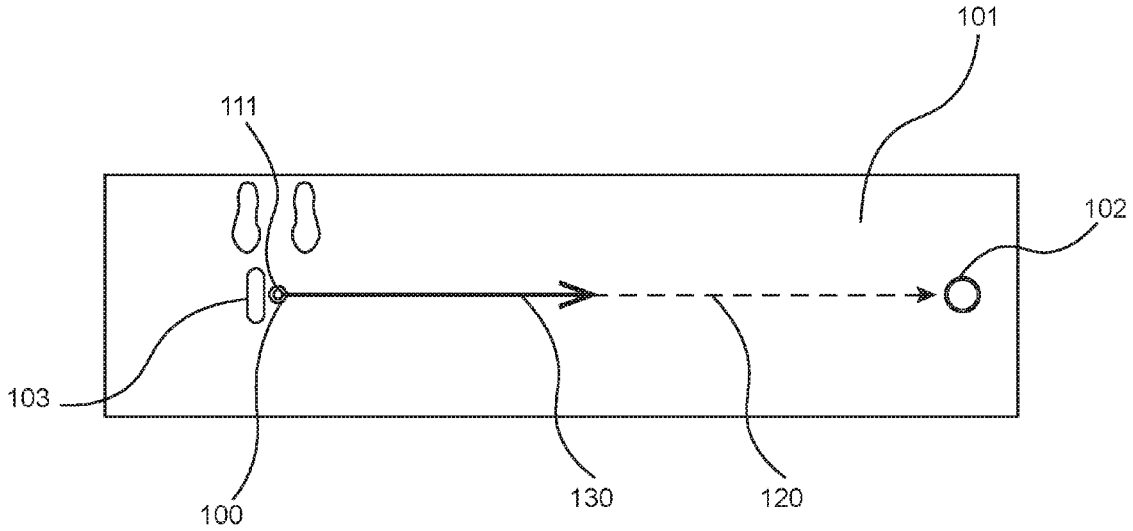
FIG. 5 is a top plan view illustrating a golf ball and a putter configuration for use with the training aid illustrated in FIGS. 1-3.
Figure 6:
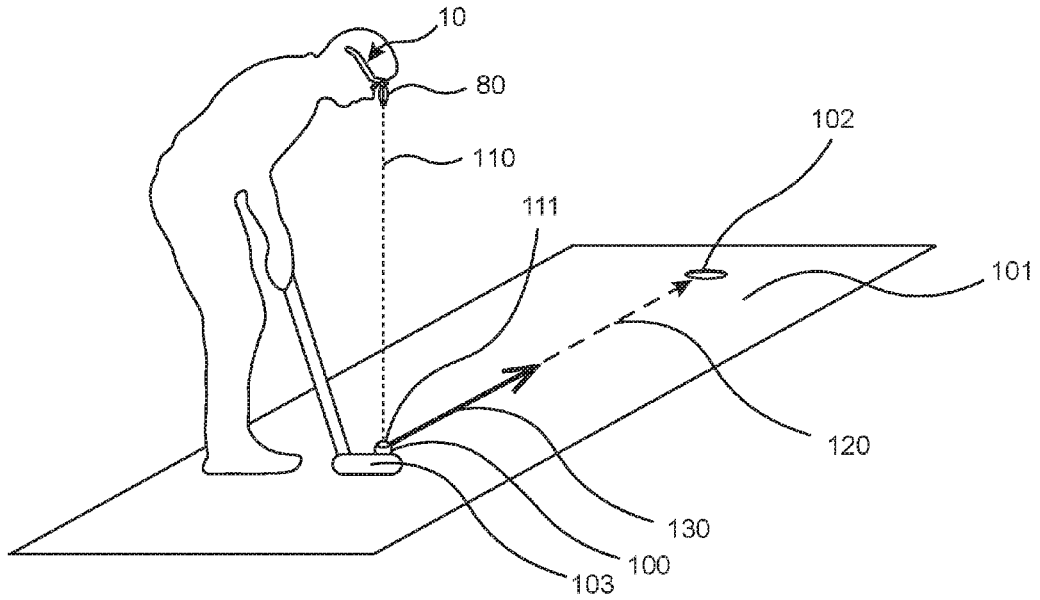
FIG. 6 is a perspective view of the configuration illustrated in FIG. 5.

Once the training aid 10 is placed on the head of the user and is activated to generate the beam of light, the user must then properly adjust the first casing segment 60 and the second casing segment 70 relative to the frame 20 of the training aid 10 to direct the beam of light to the desired target, which for putting is a standard golf ball 100, as shown in FIGS. 5 and 6. The rotatable coupling of the first casing segment 60 to the frame 20 and the rotatable coupling of the first casing segment 60 to the second casing segment 70 allows for proper adjustment of the tilt of the light source 80 relative to the frame 20. Indicia (not shown) may also be provided on the first casing segment 60 and/or the second casing segment 70 to return to a known desired setting or ensure the training aid 10 is used in the same position to provide desired repeatability for the user. For example, the indicia may be provided on or adjacent the first hinge assembly 45 and/or the second hinge assembly 75, as non-limiting examples.

The user may first place himself or herself in a desired putting position wherein the user is standing adjacent the golf ball 100, as shown in FIGS. 5 and 6. The user is shown in FIGS. 5 and 6 as being positioned on a planar putting surface 101 having a hole 102 formed therein and spaced apart from the user and the golf ball 100. In addition to the training aid 10, the user is equipped with a putter 103 for carrying out the putting stroke. The planar putting surface 101 is horizontally arranged to cause the golf ball 100 to have a substantially rectilinear path when struck by the putter 103.

Once in the desired and customary putting position of the user, the user may then rotate one or more of the first casing segment 60 and the second casing segment 70 until the beam of visible light is directed toward and overlaying an outer surface of the golf ball 100. The light beam emitted from the light source 80 is indicated in FIG. 6 as dashed line 110. A distal end of the light beam is visible when the beam of visible light encounters a surface. The distal end of the beam of visible light forms a pointer 111 via the beam of visible light, which is illustrated in FIGS. 5 and 6. The pointer 111 may be in the form of a visible dot or circle of light such as produced by a laser pointer and the like.

The training aid 10 beneficially allows the user to position his or her head directly over the golf ball 100 or otherwise as desired to cause the user to be properly positioned for the putting stroke. The user may reference the position of the pointer 111 relative to the golf ball 100 to determine if the user is properly positioned relative to the golf ball 100 when the user looks downward toward the golf ball 100. The user may then reposition his or her feet or may rotate his or her head to ensure proper positioning of the user for the putting stroke.

Once properly positioned, the user maintains a desired position of the user's head, wherein the pointer 111 is continuously maintained on the golf ball 100 or a select portion of the golf ball 100. The training aid 10 allows the user to determine if minor rotation or translation of the head has occurred by monitoring the position of the pointer 111 formed by the beam of visible light. The distance formed between the light source 80 and the putting surface 101 causes relatively small rotations of the head to be displayed to the user as relatively large visible deviations of the positioning of the pointer 111 relative to the golf ball 100. The training aid 10 therefore beneficially provides the user with feedback regarding the user's positioning that is exaggerated in comparison to the user's ability to self-determine an angle at which the user's head has deviated from a desired angle. The user attempts to maintain the pointer 111 on the golf ball 100 prior to the putting stroke to train the user to keep the user's head in a fixed position prior to the putting stroke, thereby increasing repeatability of the putting stroke by ensuring the putting stroke starts from a common and repeatable position.

Once the user is properly positioned and the pointer 111 is maintained on the golf ball 100 in a desired manner, the user continues utilization of the training aid 10 to further improve the act of performing the putting stroke to make consistent contact the golf ball 100. The putting stroke generally includes the user pivoting the putter 103 about an axis adjacent the hands or an axis above the hands of the user in a pendulum motion to cause a face of the putter 103 to strike the golf ball 100 in a desired direction. The moving of the putter 103 during the putting stroke may cause the user to accidentally or unintentional move other portions of the user's body that can frustrate the repeatability of the putting stroke. In many instances, the motion of the arms of the user during the putting stroke may cause the body or the head of the user to sway or rotate away from the desired position wherein the pointer 111 is trained on the golf ball 100. The training aid 10 provides a visual indication to the user in the form of the pointer 111 whether or not the user has deviated from the desired position wherein the pointer 111 is maintained on the golf ball 100 during the putting stroke. The user trains with the training aid 10 by repeatedly attempting to perform the putting stroke while maintaining the pointer 111 in the desired position, despite the movement of other portions of the body of the user during the putting stroke.

The training aid 10 further aids the user in perfecting the portions of the putting stroke immediately following contact with the golf ball 100. In many instances the user may maintain the pointer 111 on the golf ball 100 throughout a majority of the putting stroke only to have the head of the user deviate from the intended path upon making contact with the golf ball 100. Such a problem may be referred to as not "following through" with the putting stroke or having a poor "follow through," wherein the motion leading up to contact with the golf ball 100 is discontinued upon contact in a manner that promotes poor habits with regards to control of the putting motion. For example, some golfers may improperly utilize short choppy motions or angled motions that result in the putter 103 traveling along a path that is not on the intended putting line. It is important for such golfers to practice guidance of the putter 103 following contact with the golf ball 100.

FIGS. 5 and 6 further illustrate a putting line 120 and a putting path 130 associated with the putting stroke. The putting line 120 is a line extending from the golf ball 100 in a direction in which the golf ball 100 is intended to be struck. In the case of the horizontally planar putting surface 101 shown in FIGS. 5 and 6, the putting line 120 is a rectilinear line extending directly from the golf ball 100 to the hole 102. It should be understood that other putting lines may be utilized for different putting conditions. The putting path 130 is shown as extending from the golf ball 100 on the putting line 120. The putting path 130 represents a path that each of the pointer 111 of the light source 80 and the face of the putter 103 should follow immediately after contact with the golf ball 100 to ensure that the user continues the putting motion in a repeatable motion throughout the putting stroke. For example, a proper putting stroke may include the head of the user rotating in a manner to follow the path of the golf ball 100 immediately following contact therewith. The user may utilize the training aid 10 to compare a path of the golf ball 100, the face of the putter 103, and the pointer 111 (and hence, the motion of the head of the user) relative to the putting line 120. The proper putting stroke includes each of the above being aligned along the putting path 130, which is indicated to the user by visual inspection of the pointer 111 following contact with the golf ball 100.

Once the user has completed the putting stroke, it may be common for the user to then place his or her head in an upright position to go and retrieve the golf ball 100. In such cases, the inclinometer 96 may cause the light source 80 to discontinue emitting the beam of visible light if the head of the user is rotated upwardly beyond the predetermined tilt angle. As explained hereinabove, the inclinometer 96 thereby acts as a safety feature by preventing the beam of visible light from being directed at the eyes of another individual standing adjacent the user.

In summary, the user first utilizes the training aid 10 to position the user directly over the golf ball 100 in a desirable position. Next, the user attempts to maintain a position of the pointer 111 on the golf ball 100 in anticipation of performing the putting stroke. The user then performs the putting stroke while attempting to continue to maintain the pointer 111 on the golf ball 100 until the putter 103 makes contact with the golf ball 100. Upon the putter 103 striking the golf ball 100, the user attempts to follow the putting path 130 both with the face of the putter 103 and with the pointer 111 of the light source 80 to promote a repeatable follow-through of the putting stroke. The user utilizes the training aid 10 to practice control of the body of the user throughout each stage of the putting stroke, thereby promoting precise and repeatable motions of the user.

Figure 7:
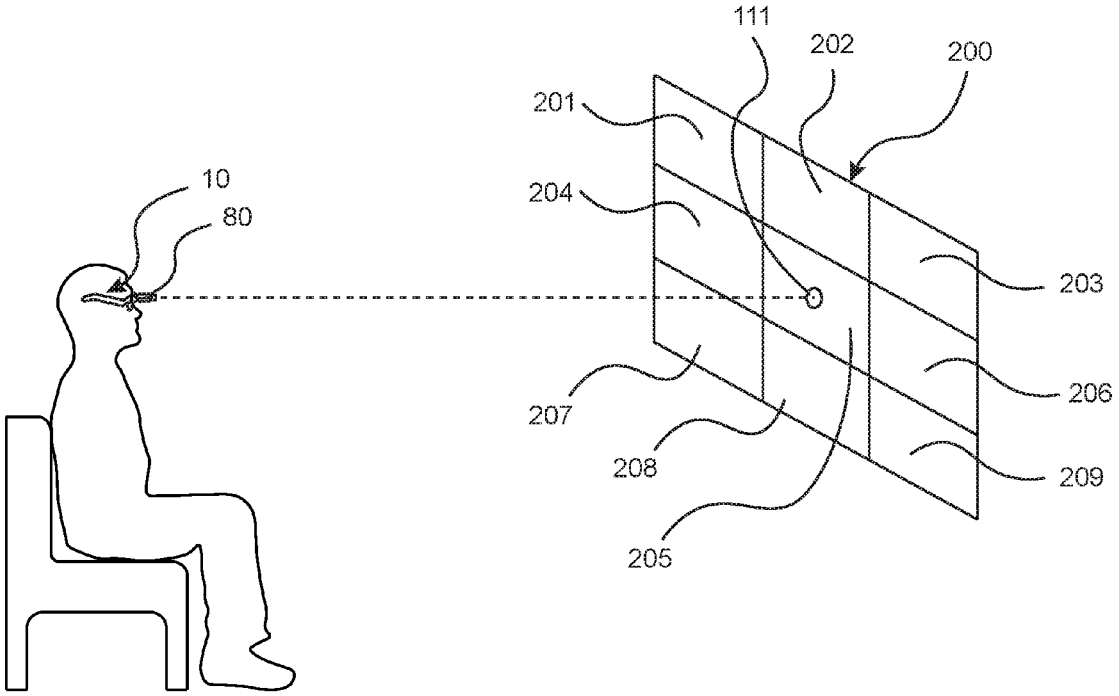
FIG. 7 is a side elevational view of a user wearing the training aid and directed toward a rehabilitation graphic for a range of motion activity.

The training aid 10 may alternatively be used as a physical therapy training aid, as shown in FIG. 7. The user first places the training aid 10 on his or her head similar to a pair of eye glasses before then adjusting the light indicator 50 to a desired initial position by adjusting the positions of the first casing segment 60 and the second casing segment 70. As illustrated in FIG. 7, the user may be seated prior to use of the training aid 10 and the initial position of the pointer 111 may be a center of a graphic 200 spaced apart from the user in a horizontal direction. The training aid 10 illustrated in FIG. 7 may be devoid of the inclinometer 96 shut-off feature due to the need for the light beam to extend substantially horizontally based on the configuration of the user relative to the graphic 200, or the inclinometer 96 may be disabled when used in the example provided as a physical therapy training aid. It is understood that other physical therapy applications could utilize the inclinometer 96, if desired. The graphic 200 illustrated in FIG. 7 is substantially grid-like with nine separate squares individually labelled as squares 201-209, but it should be understood that the graphic 200 may have any configuration suitable for the desired application. For example, the graphic 200 may be exclusively linear and may include measuring indicia formed thereon.

As a non-limiting example, the user may attempt to rehabilitate an injured neck or neck muscle preventing a full range of motion of the head of the user. As explained above, the user may begin each exercise by first directing the pointer 111 to a desired location such as the central square of the graphic 200 labeled as square 205. Subsequently, the user may attempt to follow a predetermined direction or pattern on the graphic 200 to exercise and extend a range of motion of the head and the neck. For example, the user may rotate the head of the user from the leftmost central square 204 to the rightmost central square 206 and back again in repeated fashion. Alternatively, the user may tilt the head of the user to cause the pointer 111 to travel from the lower-left square 207 through the central square 205 and then to the lower-right square 209, for example. In yet another example, the user may tilt the head of the user to direct the pointer 111 from the uppermost central square 202 to the lowermost central square 208. In all cases, it may be beneficial for the user to begin by moving the pointer 111 through a limited range of motion before slowly progressing to extend the targeted area to include a greater range of motion, thereby allowing the user to progress slowly when muscle flexibility is a concern. It should be understood that a prescribed pattern of the user may be dependent on the configuration of the graphic 200 and the exercises required to rehabilitate the specified part of the body of the user. Similarly, the range of motion of the user may be measured and recorded through visual observation of the location of the pointer 111 relative to a distance of the user from the graphic 200 in order to provide feedback to the user in respect of improvement of the rehabilitation or physical therapy. The user may therefore be aware of specific information such as an angle of rotation through which the muscle in question is cable of rotating and the degree of improvement that has occurred to reach that range of motion.

It should further be understood that the training aid 10 may further be adapted for applications not involving the use of the frame 20 configured to be placed on the head of the user. For example, one skilled in the art may adapt the training aid 10 to include structure suitable for coupling the training aid 10 to any portion of the body of the user in need of further rehabilitation. For example, the training aid 10 may be adapted to be placed on a foot of the user with the light source 80 oriented to point in a direction toward the toes of the user, and the user may then test a range of motion of an ankle by directing the pointer 111 toward a graphic in similar fashion to the head-mounted training aid 10 illustrated in FIG. 7.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A training aid for placement on a head of a user, the training aid comprising:

a frame including a front bar and a pair of temple bars pivotally coupled to each end of the front bar, a central portion of the front bar forming a bridge configured to be positioned adjacent the head of the user when placed on the head of the user; and a light indicator coupled to the bridge of the front bar of the frame, the light indicator including a first casing segment and a second casing segment, a first end of the first casing segment pivotally coupled to the bridge of the front bar and a second end of the first casing segment pivotally coupled to a first end of the second casing segment, wherein the light indicator includes a light source disposed on the first end of the second casing segment, the light source configured to generate a beam of visible light, wherein a pivoting of the first casing segment with respect to the bridge of the front bar of the frame causes a spacing between the light source and the head of the user to vary.

2. The training aid of claim 1, wherein the light indicator further includes an inclinometer configured to control the light source depending on a tilt angle of the light source.

3. The training aid of claim 2, wherein the light source does not generate the beam of light when the inclinometer detects that the light source is directed at an angle deviating from a preselected tilt angle.

4. The training aid of claim 3, wherein the light indicator further includes a power source and a controller, wherein the controller is configured to discontinue electrical communication between the power source and the light source when the inclinometer detects the light source is directed at the angle deviating from the preselected tilt angle.

5. The training aid of claim 1, wherein the second casing segment includes a compartment for storing an energy source of the light source.

6. The training aid of claim 5, wherein the compartment is accessed by pivoting the second casing segment relative to the first casing segment to move the second end of the the second casing segment away from the first end the first casing segment to increase an angle formed between the first casing segment and the second casing segment.

7. The training aid of claim 1, wherein the pivoting of the first casing segment with respect to the bridge of the front bar of the frame causes an axis of rotation of the second casing segment to orbit with respect to the bridge of the front bar of the frame to cause the spacing between the light source and the head of the user to vary.

8. A method of performing physical therapy using a training aid, the method comprising the steps of:

mounting the training aid to a portion of a user, the training aid including a light source for generating a beam of visible light, a distal end of the beam of visible light forming a pointer;

directing the pointer of the beam of visible light on a graphic, the graphic including a plurality of spaced apart indicia;

translating the pointer adjacent a preselected path on the graphic by rotating the portion of the user having the training aid about at least one axis, the preselected path determined on the graphic with respect to the plurality of the spaced apart indicia; and monitoring a position of the pointer of the beam of visible light relative to the preselected path on the graphic during the translating step to determine a deviation of the position of the pointer from the preselected path on the graphic.

9. The method of claim 8, wherein the preselected path extends between two of the plurality of the spaced apart indicia and the translating of the pointer includes the pointer translating in opposing directions between the two of the plurality of the spaced apart indicia.

10. The method of claim 9, wherein a known distance between the training aid and the graphic is compared to a known distance between the two of the plurality of the spaced apart indicia to determine an angular range of motion required by the portion of the user having the training aid to translate the pointer between the two of the plurality of the spaced apart indicia.

11. The method of claim 10, wherein the monitoring step includes determining an actual angular range of motion of the portion of the user having the training aid using the deviation of the position of the pointer from the preselected path and the determined angular range of motion.

12. The method of claim 8, wherein a degree of the deviation of the position of the pointer from the preselected path during the translating step is used to determine a progress of rehabilitation of a muscle of the user controlling the portion of the user having the training aid.

13. The method of claim 12, wherein the portion of the user having the training aid is a head of the user and the muscle of the user is a neck muscle of the user.

14. The method of claim 12, wherein the portion of the user having the training aid is one of a hand or a foot of the user.

* * * * *